US005544943A

United States Patent [19]

Durling

[11] Patent Number: 5,544,943

[45] Date of Patent: Aug. 13, 1996

[54] SEAT CONSTRUCTION AND METHOD

[75] Inventor: Walter E. Durling, Tupelo, Miss.

[73] Assignee: Matrex Furniture Components, Inc., Greensboro, N.C.

[21] Appl. No.: 557,383

[22] Filed: Nov. 13, 1995

Related U.S. Application Data

[63] Continuation of Ser. No. 229,925, Apr. 19, 1994, abandoned.

[51] Int. Cl.[6] ..... A47C 7/02

[52] U.S. Cl. ..... 297/452.56; 297/452.63; 297/452.64; 5/191; 267/103

[58] Field of Search ..... 297/452.56, 452.63, 297/452.64; 5/186.1, 190, 191, 195, 196, 197, 198; 267/103

[56] References Cited

U.S. PATENT DOCUMENTS

| | | | |
|---|---|---|---|
| 1,987,921 | 1/1935 | Bertsch | 5/191 X |
| 2,878,861 | 3/1959 | Molla | 297/452.64 X |
| 3,057,613 | 10/1962 | Benjamin | 297/452.63 X |
| 3,107,944 | 10/1963 | Baermann | 297/452.56 |
| 3,117,327 | 1/1964 | Mathew | 297/452.63 X |
| 3,165,308 | 1/1965 | Rathbun | 297/452.56 X |
| 3,332,719 | 7/1967 | Flint | 267/103 |
| 3,498,598 | 3/1970 | Rathbun | 267/103 |
| 4,685,738 | 8/1987 | Tinus | 297/452.64 X |
| 4,837,878 | 6/1989 | Huemer | 297/452.63 X |
| 4,886,250 | 12/1989 | Lucas | 267/103 X |
| 5,188,343 | 2/1993 | Galea | 267/103 |

FOREIGN PATENT DOCUMENTS

| | | | |
|---|---|---|---|
| 138725 | 9/1934 | Austria | 297/452.56 |
| 1144127 | 10/1957 | France | 297/452.63 |
| 642000 | 7/1962 | Italy | 297/452.64 |
| 1580945 | 12/1980 | United Kingdom | 297/452.63 |

*Primary Examiner*—Peter M. Cuomo
*Assistant Examiner*—Rodney B. White

[57] ABSTRACT

A seat construction for upholstered furniture is presented and a method of forming the same and includes a rectangular frame with webbing attached in the form of lateral strips positioned across the frame. Spaced therebelow are webbing strips which are positioned longitudinally along the frame. When a person uses the seat, the upper webbing strips allow maximum stretching and contact the second webbing strips, which are less stretchable and more supportive, to provide a luxurious feel and maximum comfort.

20 Claims, 3 Drawing Sheets

SEAT CONSTRUCTION AND METHOD

This is a continuation of pending application Ser. No. 08/229,925 filed 19 Apr. 1994, now abandoned.

BACKGROUND OF THE INVENTION

1. Field of the Invention

The invention herein pertains to furniture seat constructions and a method of forming the same and particularly refers to a seat for an upholstered chair.

2. Description of the Prior Art and Objectives of the Invention

Coil springs have been commonly used in upholstered furniture for many years and more recently flat, sinuous springs have been employed. Seats for inexpensive chairs have been marketed for many years which employ frames with fabric or other webbings positioned thereon to support seat cushions but these seats do not have the resiliency or comfort of conventional seats employing metal springs. It has also been known in the past to utilize vinyl or fabric strips to support seat cushions, again without the feel and comfort of seats constructed with metal springs. While various types of seat constructions have achieved different degrees of success and acceptability, there has remained a void in the furniture industry for a seat construction utilizing webbings which provides the comfort, give and feel of the more expensive and complex spring seat constructions.

With the disadvantages of prior art seat constructions and methods, it is an objective of the present invention to provide a seat construction and method of forming the same which will provide the user with a durable, comfortable seat.

It is another objective of the present invention to provide a seat construction which will provide the feel and comfort of more expensive spring seat constructions at a much lower price.

It is yet another objective of the present invention to provide a seat construction employing upper and lower webbings which are vertically spaced, one from the other, and attached to a rectangular frame.

It is still another objective of the present invention to provide a seat construction and method which is relatively simple and inexpensive to manufacture.

Various other objectives and advantages of the present invention will become apparent to those skilled in the art as a more detailed description is set forth below.

SUMMARY OF THE INVENTION

The invention herein pertains to a seat construction and method of forming the same whereby a wooden rectangular frame is constructed of individual side, back and front members. A first lower webbing comprises a plurality of stretchable strips that are positioned longitudinally and are attached to the front and back frame members. Next, a second upper webbing consisting of a plurality of strips that are more stretchable are attached laterally on the side frame members by staples or the like. The second webbing is spaced vertically above the first webbing and is in stretchable contact therewith. A foam layer and fabric cover are positioned over the webbing to complete the seat. The seat construction can be used in a variety of chairs, recliners or the like for excellent feel and resiliency.

DESCRIPTION OF THE PREFERRED EMBODIMENT

Figure 1:
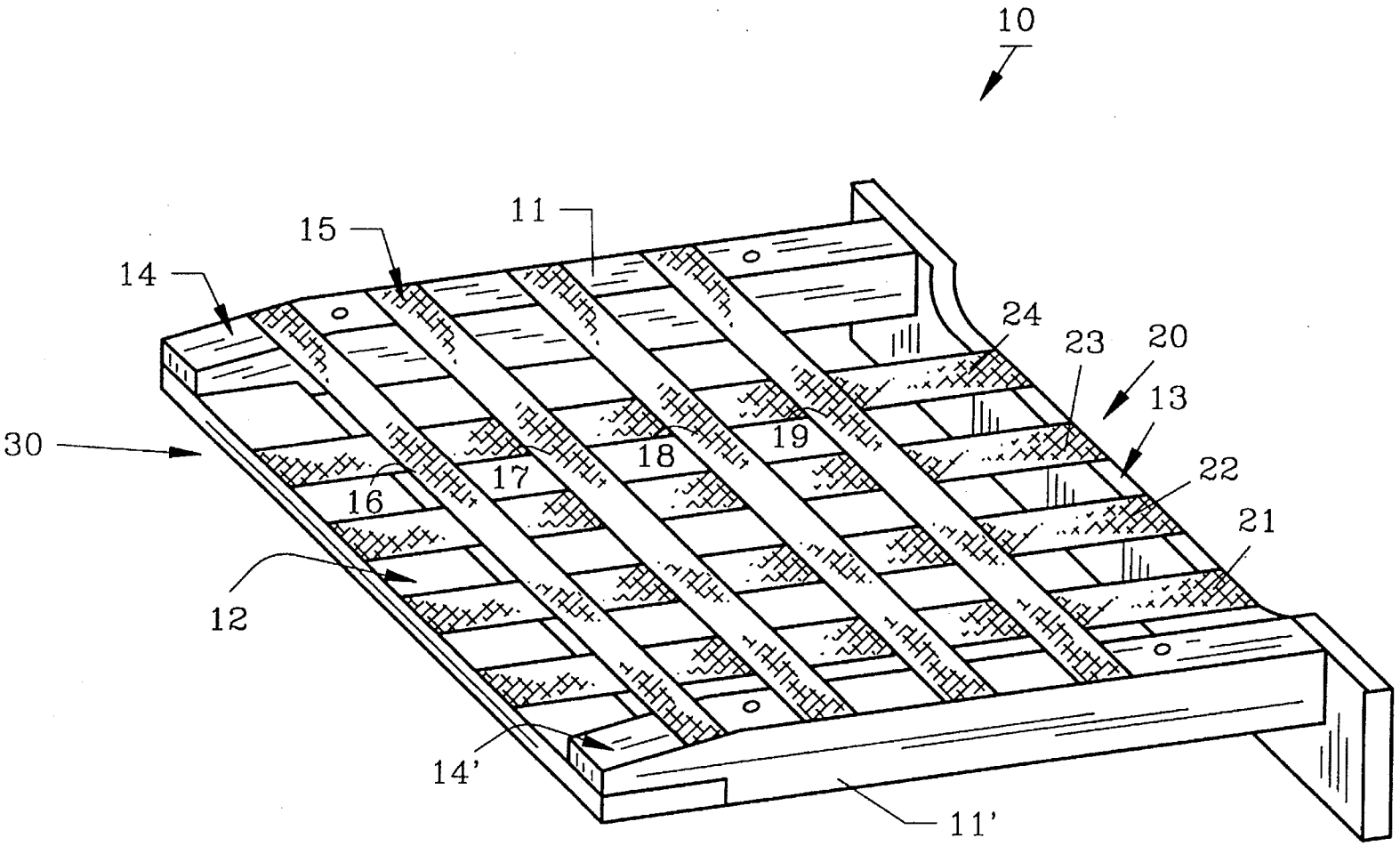
FIG. 1 illustrates a top, right side, front perspective view of the seat construction of the invention.
Figure 2:
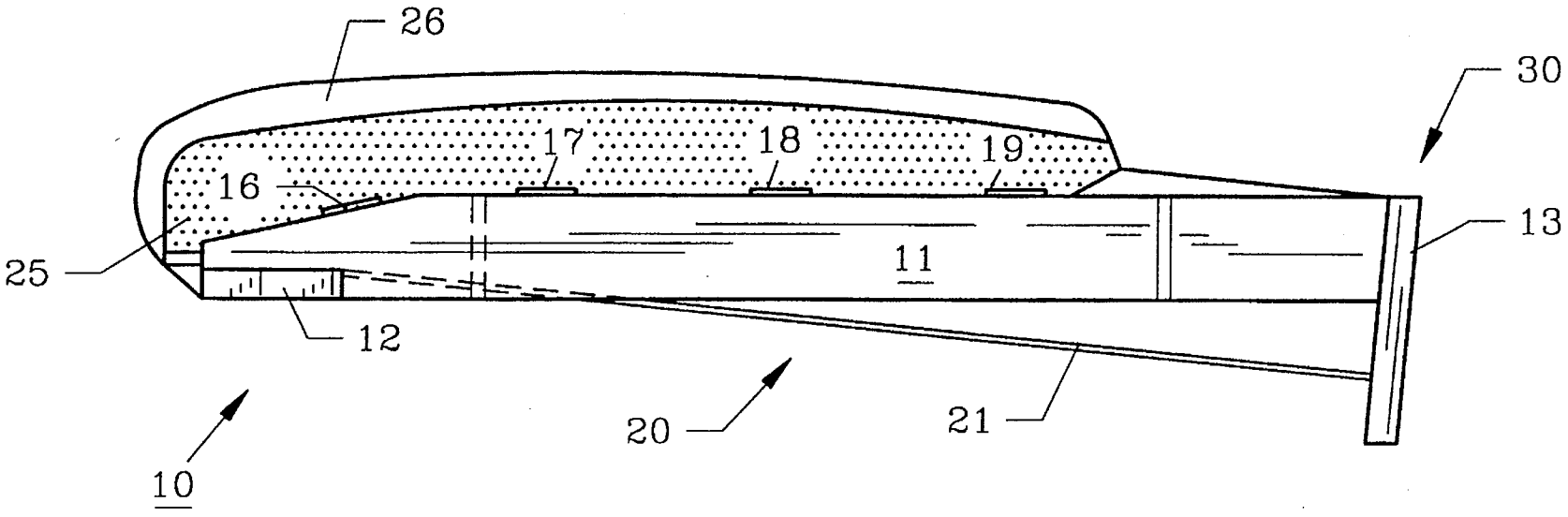
FIG. 2 shows a right side elevational view of the seat construction as seen in FIG. 1 with a foam layer and fabric covering applied thereto.

The preferred form of the seat construction is shown in FIGS. 1 and 2 whereby a rectangular seat frame is formed from wooden side, front and rear members. The rectangular frame may be approximately 24 inches in width and 26 inches in depth. A lower webbing consists of four (4) individual elastic fabric strips that are longitudinally affixed by stapling to the top of front and back frame members. An upper webbing consists of four (4) individual, stretchable elastic straps, which have a modulous of elasticity more than that of the strips of the lower webbing, and are affixed laterally across the seat frame by attaching them to the side frame members such as by stapling. A foam layer, for example, a conventional polyurethane foam, is fitted atop the upper webbing and a fabric layer is then applied over the foam to complete the seat construction.

The method of manufacturing the seat construction comprises first forming the frame from individual side, front and rear wooden members and then attaching the lower webbing longitudinally thereto. Next, the vertically spaced upper webbing is attached to the side frame members laterally along the frame whereby the upper and lower webbings are spaced a few inches apart to provide resiliency and comfort for the user by allowing the loaded upper webbing to deflect into contact with the lower webbing which is firmer, less resilient and provides additional support.

DETAILED DESCRIPTION OF THE DRAWINGS AND OPERATION OF THE INVENTION

For a better understanding of the invention, turning now to the drawings, FIG. 1 illustrates a typical embodiment of the invention wherein seat construction 10 is formed for a conventional upholstered chair, recliner or the like. As would be understood, seat construction 10 is shown for a single seat but may be modified for multiple seats, sofas, or other structures. Seat construction 10 is formed with frame 30 and includes left side member 11, right side member 11', front member 12 and rear member 13. Side members 11, 11' may be, for example, formed from 2 by 2 ½ inch alder (wood) with beveled front ends 14, 14' respectively. Front member 12 and rear member 13 may be made from 1" hardwood boards. Second webbing 15 is positioned laterally across frame 30 and comprises four parallel strips 16, 17, 18 and 19 which have a relatively high degree of elasticity and may be, for example, 2 inches wide and are stapled under slight tension to frame side members 11, 11'. Strips 16–19 may stretch to almost twice their relaxed length due to their high modulous of elasticity. First webbing 20 includes longitudinally aligned, parallel strips 21, 22, 23 and 24 which may be 2 ¼ inches wide which are attached longitudinally to frame 30 such as by stapling to front frame member 12 and rear frame member 13, also under slight tension. Strips 21, 22, 23 and 24 are likewise stretchable but have a lesser modulous of elasticity than do strips 16–19 of second webbing 15. Strips 21–24 may only stretch to an additional one-fourth to one-half of their relaxed length and are thus more supportive under loaded conditions. Strips 16–19 and 21–24 are formed of nylon and elastic yarns, such as by warp knitting, although other yarn types and fabrics may be used. As would be understood, frame 30 is shown made of wooden members 11, 11', 12 and 13 although metal, plastic or other materials or configurations may be used as appropriate.

Comfort is one of the main advantages derived from seat construction 10, which is due in part to the vertical spacing of second webbing 15 and first webbing 20. As shown in FIG. 2, strip 16 is vertically spaced only approximately one inch from strip 21 whereas strip 19 is vertically spaced about two and one-half inches from strip 21 due to the biased placement of first webbing 20.

When seat construction 10 is loaded, such as by sitting thereon, strips 16, 17, 18 and 19 will readily stretch and deflect and under the weight of an average adult, said strips will contact first webbing strips 21, 22, 23 and 24. Strips 21–24 will then only minimumly deflect and will provide a firm support for the user. The degree or amount of deflection of strips 16–19 is related to the work load (weight of the individual sitting thereon) and also the density of foam covering 25 which is a conventional polyurethane foam as used in the furniture trade. Fabric covering 26 illustrates a conventional fabric as also conventionally used in the furniture trade and may or may not have a foam backing.

As further shown in FIG. 2, first webbing 20 is vertically biased in that strips 21–24, as shown in FIG. 1, are affixed to front frame member 12 and descend longitudinally therealong frame 30 to attachment to rear frame member 13. This biased positioning of first webbing 20 adds increased comfort but first webbing 20 may be horizontally positioned if desired for certain furniture seats.

Figure 3:
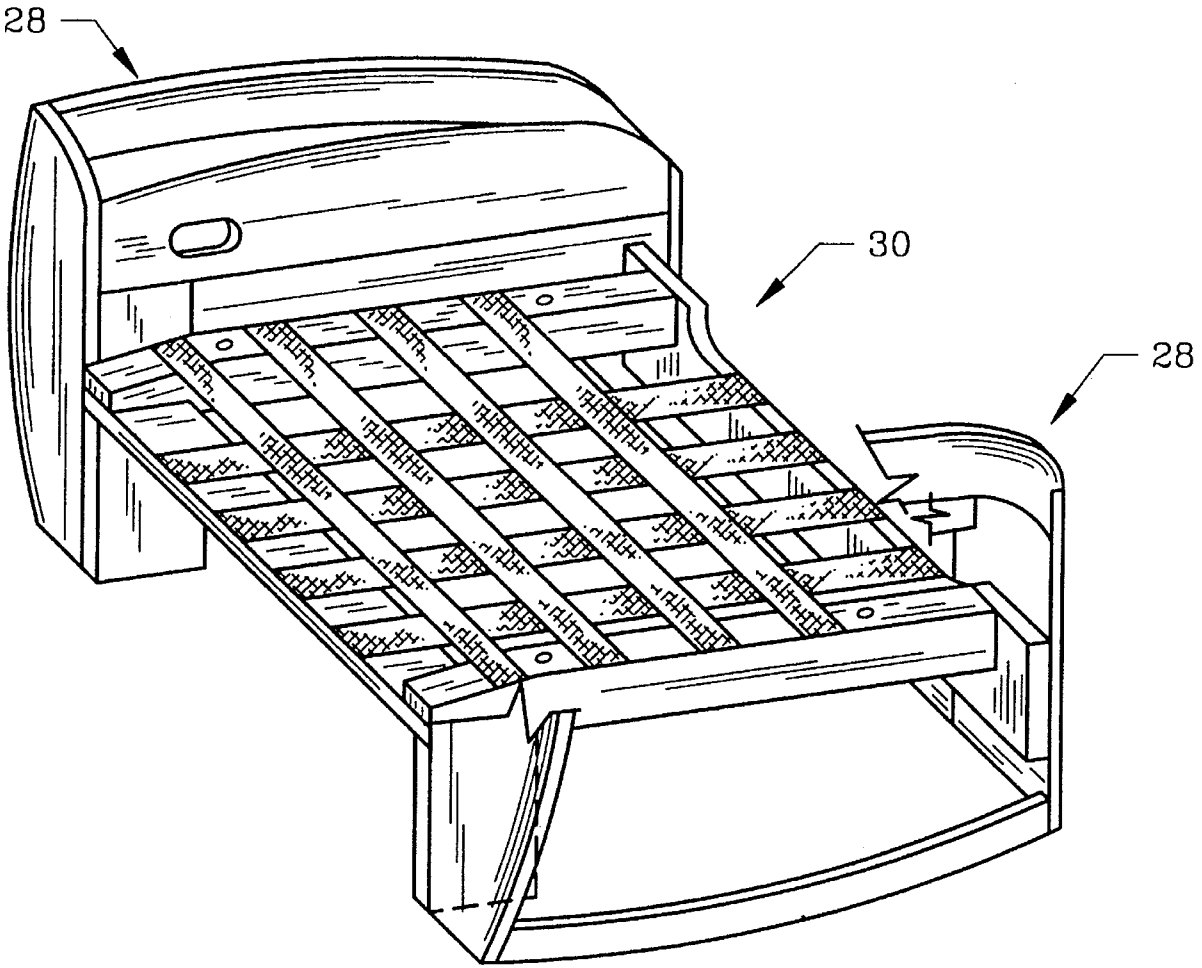
FIG. 3 demonstrates a typical installation of the seat frame as seen FIG. 1 attached to recliner leg assemblies.

A use of frame 30 is seen in FIG. 3 with leg assemblies 28, 28 affixed thereto. Leg assemblies 28, 28 are conventional as are used in typical recliners. No upholstery or back construction is seen in this view, which merely demonstrates the location of seat frame 30 in a typical chair construction.

All illustrations and examples provided herein are merely for explanatory purposes and are not intended to limit the scope of the appended claims.

I claim:

1. Seat construction comprising: a frame, said frame having a pair of sides, a front, and a rear, said front and said rear attached to each of said sides, said front and said rear positioned vertically lower than said sides, a first stretchable webbing, said first stretchable webbing attached to said vertically lower front and rear, a second stretchable webbing, said second stretchable webbing attached to said sides, said second stretchable webbing being vertically, angularly spaced from and incontiguous to said first stretchable webbing.

2. Seat construction as claimed in claim 1 wherein said first stretchable webbing is attached longitudinally along said frame to said vertically lower front and rear.

3. Seat construction as claimed in claim 1 wherein said second stretchable webbing is attached laterally to said sides perpendicular to said first stretchable webbing.

4. Seat construction as claimed in claim 1 wherein said first webbing comprises an elastic strap.

5. Seat construction as claimed in claim 1 wherein said second webbing comprises an elastic strap.

6. Seat construction as claimed in claim 1 wherein said second webbing has a higher modulus of elasticity than does said first webbing.

7. Seat construction as claimed in claim 1 wherein said first webbing comprises a plurality of parallel strips.

8. Seat construction as claimed in claim 1 wherein said second webbing comprises a plurality of parallel strips.

9. Seat construction as claimed in claim 1 wherein said first webbing is biasedly attached to said frame.

10. Seat construction as claimed in claim 1 wherein said frame is rectangular in shape.

11. Seat construction comprising: a frame, a first stretchable webbing, said first stretchable webbing attached to said frame, a second stretchable webbing, said second stretchable webbing attached to said frame angularly to said first stretchable webbing, said second stretchable webbing being vertically spaced from and incontiguous to said first stretchable webbing, said first and said second stretchable webbing comprising an elastic material, said second stretchable webbing being stretchable from its incontiguous position into contact with said first stretchable webbing upon load application to said second stretchable webbing.

12. Seat construction as claimed in claim 11 wherein said second webbing is attached laterally to said frame.

13. Seat construction as claimed in claim 11 wherein said first webbing is attached longitudinally to said frame.

14. Seat construction as claimed in claim 11 wherein said first webbing is biasedly positioned on said frame.

15. Seat construction as claimed in claim 11 and further comprising a resilient layer, said resilient layer positioned on said second webbing.

16. Seat construction as claimed in claim 15 and including a cover, said cover positioned on said resilient layer.

17. A method of forming a furniture seat comprising the steps of:

(a) forming a rigid frame;

(b) attaching a first stretchable webbing to said frame;

(c) vertically angularly spacing a second stretchable webbing incontiguous from said first stretchable webbing; and (d) attaching said second stretchable webbing to said frame.

18. The method of claim 17 wherein the step of attaching said second webbing to said frame comprises the step of attaching a plurality of elastic strips laterally along said frame.

19. The method of claim 17 wherein the step of attaching said first webbing to said frame comprises attaching a plurality of elastic strips longitudinally along said frame.

20. The method of claim 17 wherein the step of vertically spacing said second webbing continuously incontiguous from said first stretchable webbing comprises the step of vertically spacing said second stretchable webbing a few inches remotely above said first webbing.

* * * * *